US008405570B2

(12) United States Patent
Lewry et al.

(10) Patent No.: US 8,405,570 B2
(45) Date of Patent: Mar. 26, 2013

(54) SEGMENTED ANTENNA REFLECTOR WITH SHIELD

(75) Inventors: Matthew Lewry, Limekilns (GB); Stephen Simms, Dunfermline (GB); Steven Bell, Glenrothes (GB)

(73) Assignee: Andrew LLC, Hickory, NC (US)

( * ) Notice: Subject to any disclaimer, the term of this patent is extended or adjusted under 35 U.S.C. 154(b) by 485 days.

(21) Appl. No.: 12/789,446

(22) Filed: May 27, 2010

(65) Prior Publication Data

US 2011/0291914 A1 Dec. 1, 2011

(51) Int. Cl.
*H01Q 15/14* (2006.01)

(52) U.S. Cl. ..... 343/912; 343/881; 343/915; 343/916

(58) Field of Classification Search ..... 343/880, 343/881, 912, 914, 915, 916
See application file for complete search history.

(56) References Cited

U.S. PATENT DOCUMENTS

| | | | | |
|---|---|---|---|---|
| 3,234,550 | A * | 2/1966 | Thomas | 343/912 |
| 3,397,399 | A | 8/1968 | Carman et al. | |
| 3,543,278 | A * | 11/1970 | Payne | 343/915 |
| 3,715,760 | A | 2/1973 | Palmer | |
| 4,458,251 | A | 7/1984 | Bondon | |
| 4,506,271 | A | 3/1985 | Gonzalez | |
| 4,529,277 | A | 7/1985 | Gee et al. | |
| 4,710,777 | A * | 12/1987 | Halverson | 343/840 |
| 4,893,132 | A | 1/1990 | Habibi | |
| 4,994,816 | A * | 2/1991 | Kondo | 343/762 |
| 5,162,811 | A * | 11/1992 | Lammers et al. | 343/915 |
| 5,255,006 | A | 10/1993 | Pappas et al. | |
| 6,624,796 | B1 | 9/2003 | Talley et al. | |
| 7,023,401 | B2 | 4/2006 | Thrash et al. | |
| 7,324,057 | B2 | 1/2008 | Argaman et al. | |
| 7,859,479 | B2 | 12/2010 | Legare et al. | |
| 7,965,256 | B2 * | 6/2011 | Haight | 343/915 |
| 2008/0291118 | A1 | 11/2008 | Haight | |

FOREIGN PATENT DOCUMENTS

| | | |
|---|---|---|
| JP | 01-252004 | 10/1989 |
| KR | 10-0685382 | 2/2007 |

OTHER PUBLICATIONS

International Search Report and Written Opinion, International Application serial No. PCT/IB2010/055581, 8 pages, Daejeon, Republic of Korea, Jun. 30, 2011.

* cited by examiner

*Primary Examiner* — Tho G Phan
(74) *Attorney, Agent, or Firm* — Babcock IP, PLLC

(57) ABSTRACT

An antenna reflector includes a central segment with a peripheral coupling portion and a plurality of peripheral segments, each provided with a reflector portion and a shield portion. A proximal portion of each shield portion is dimensioned to couple with the peripheral coupling portion, a reflector portion edge of each peripheral segment is dimensioned to couple with adjacent reflector portion edges and a shield portion edge of each peripheral segment is dimensioned to couple with adjacent shield portion edges. The central segment and the reflector portion of the peripheral segments together form a reflector dish. The shield portions together provide a circumferential shield extending from a periphery of the reflector dish along an antenna boresight of the reflector dish.

20 Claims, 10 Drawing Sheets

SEGMENTED ANTENNA REFLECTOR WITH SHIELD

BACKGROUND

1. Field of the Invention

This invention relates to reflector antennas. More particularly, the invention relates to a segmented reflector antenna with a shield incorporated with peripheral segments of the reflector dish.

2. Description of Related Art

Reflector Antennas utilize a reflector to concentrate signals upon a subreflector and/or feed assembly. A large reflector concentrates weak signals, enabling low power, high bandwidth signal communications.

Large reflectors may be formed from a plurality of segments that are interconnected to form the desired reflector surface. Although smaller reflector segments improve the portability of the resulting antenna, each additional segment interconnection introduces the opportunity for shape errors in the assembled reflector due to cumulative misalignment and/or warping of the individual segments.

A shield extending forward of the reflector dish may be applied to improve the antenna signal pattern and/or provide an enclosure for environmental protection of a portion of the subreflector and/or feed assembly which also extends forward of the reflector dish.

A shield adds to the weight, wind load and manufacture/assembly complexity of the resulting reflector antenna assembly.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

In the exemplary embodiments herein, the segmented antenna reflector is demonstrated as a generally parabolic circular dish reflector surface for use in, for example, a reflector antenna for terrestrial point-to-point microwave communications. Alternatively, one skilled in the art will recognize that the reflector segment(s) may be formed in a range of other shapes and configurations, for example generally rectangular or elliptical, to form a reflector surface with an alternative shape, such as a planar reflector or an inner or outer toroidal section.

Figure 1:
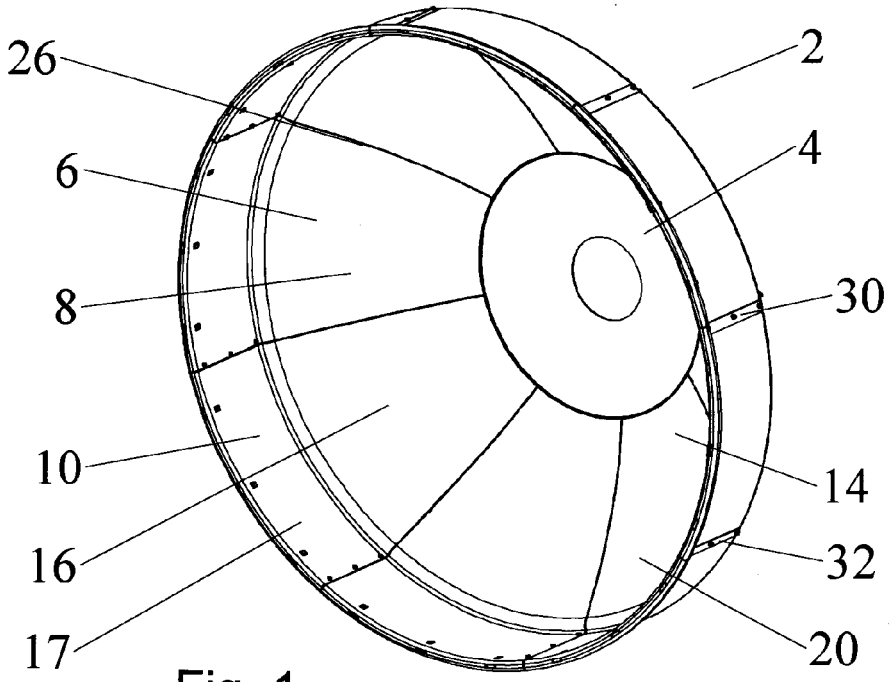
FIG. 1 is a schematic isometric front view of an exemplary antenna reflector.
Figure 2:
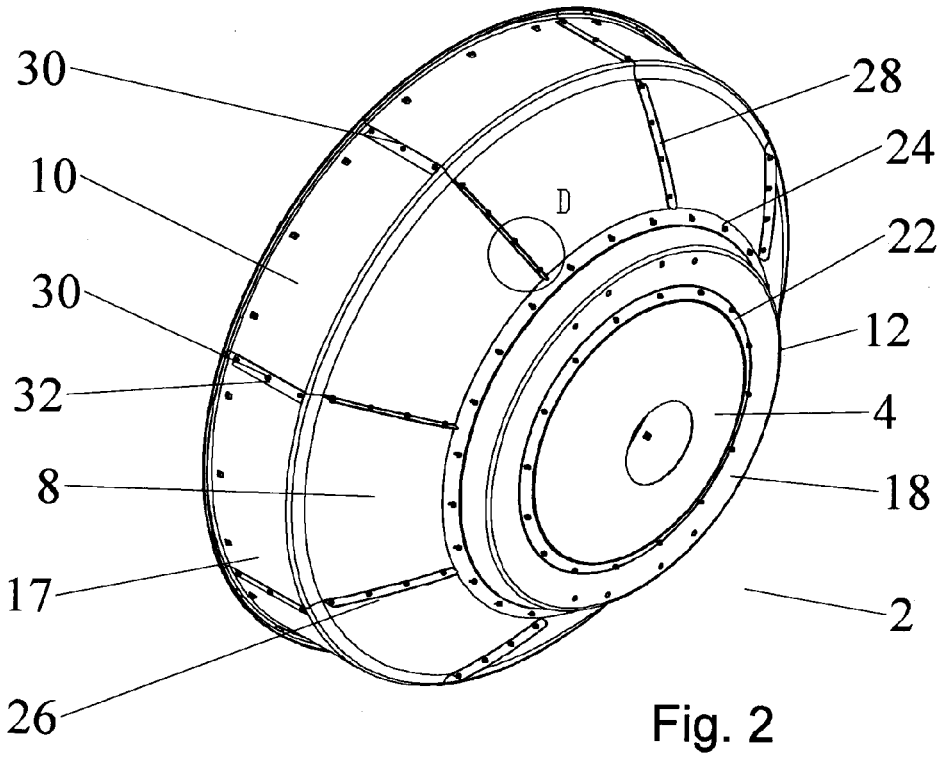
FIG. 2 is a schematic isometric back view of FIG. 1.

A first exemplary embodiment of a segmented antenna reflector 2, comprising a central segment 4 with a plurality of peripheral segment(s) 6, each with a reflector portion 8 and a shield portion 10, will now be described with reference to FIGS. 1-2. The central segment 4 is provided with a peripheral coupling portion 12 to which a proximal portion 14 of each peripheral segment 8 is attached.

The reflector portion(s) 8 are dimensioned to extend a surface curvature of the central portion 4 outward, co-operating with the central portion 4 to form a reflector dish 16 of the desired size and geometry with respect to a feed arrangement, for example, coupled to a feed hole of the central segment 4 or otherwise supported with respect to the reflector dish 16. The selected feed arrangement may be a feed or a further subreflector which redirects signals into a feed waveguide or separately mounted feed. Such feed arrangements are well known in the art and as such are not further described herein.

Figure 3:
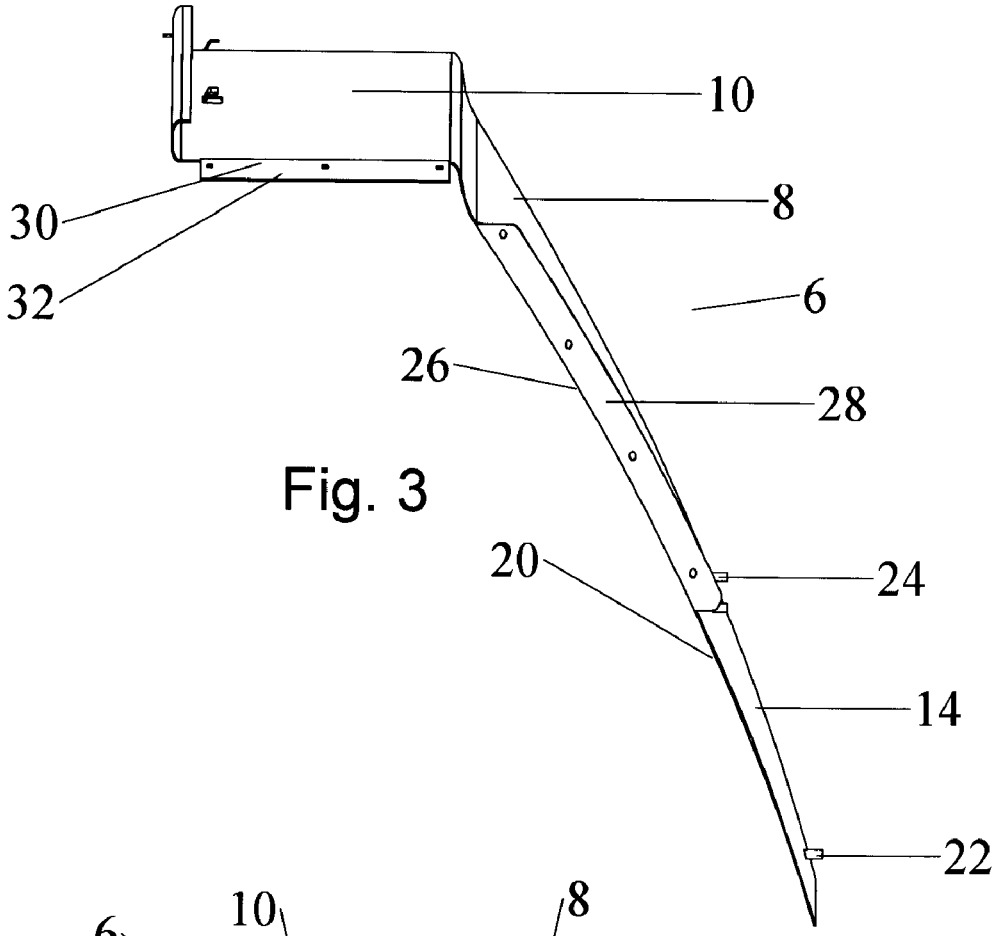
FIG. 3 is a schematic isometric side view of a peripheral segment of FIG. 1.
Figure 4:
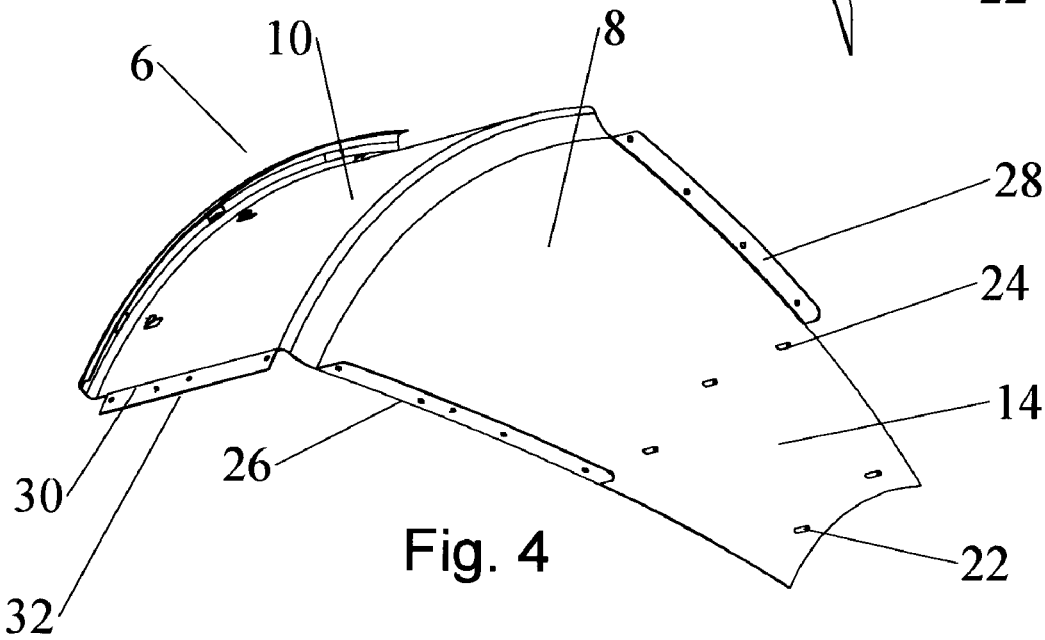
FIG. 4 is a schematic isometric angled back view of a peripheral segment of FIG. 1.

As best shown in FIGS. 3 and 4, the shield portion(s) 10 of the peripheral segment(s) 6 are angled with respect to the respective reflector portion(s) 8, dimensioned to together form a circumferential shield 17 extending from a periphery of the reflector dish 16 along a boresight of the reflector dish. The boresight is understood by one skilled in the art as the direction of maximum gain of a microwave antenna. For typical point to point microwave communications via parabolic reflector dish antennas, the boresight may be approximated as perpendicular to a plane of the periphery of the reflector dish 16. To serve as a environmental and/or signal pattern control shield, rather than a mere reinforcing rim feature or the like, the circumferential shield 17 may be formed extending from the periphery of the reflector dish 16 by at least 10 percent of a peripheral diameter of the reflector dish 16.

Figure 5:
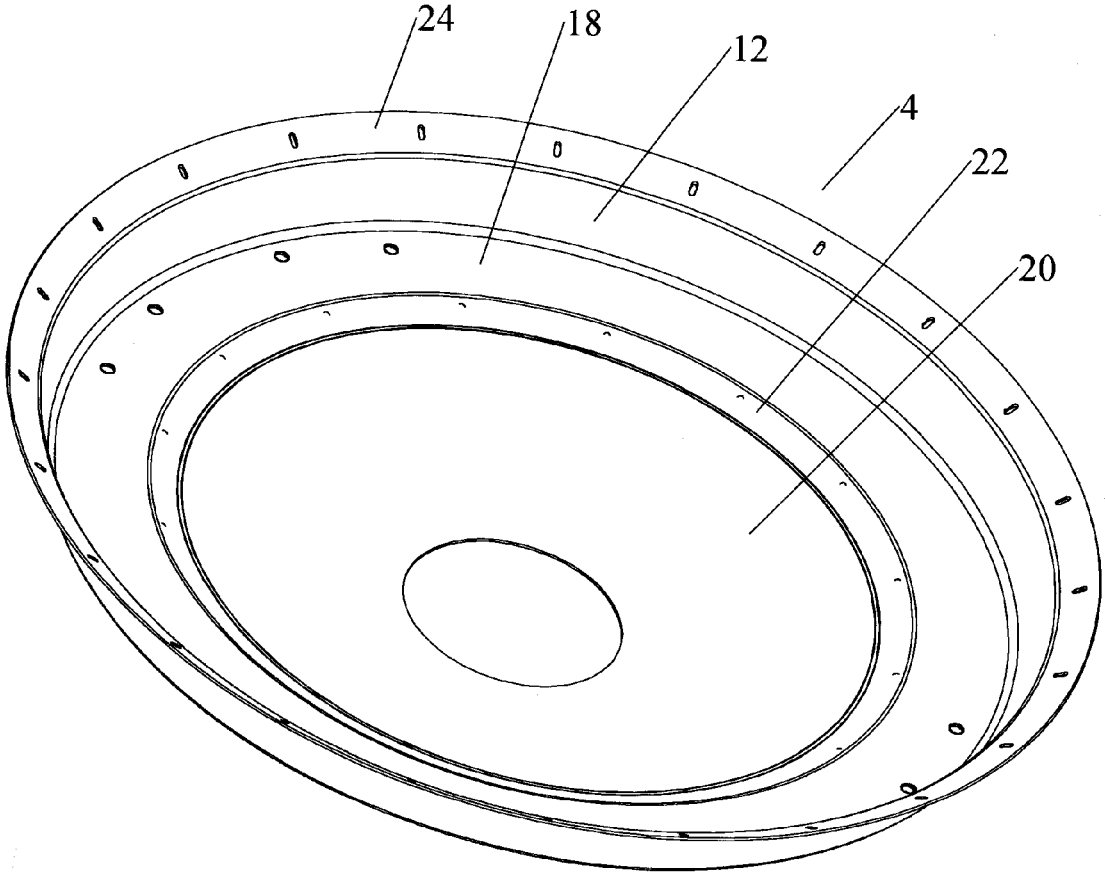
FIG. 5 is a schematic isometric angled front view of a central segment of FIG. 1.
Figure 6:
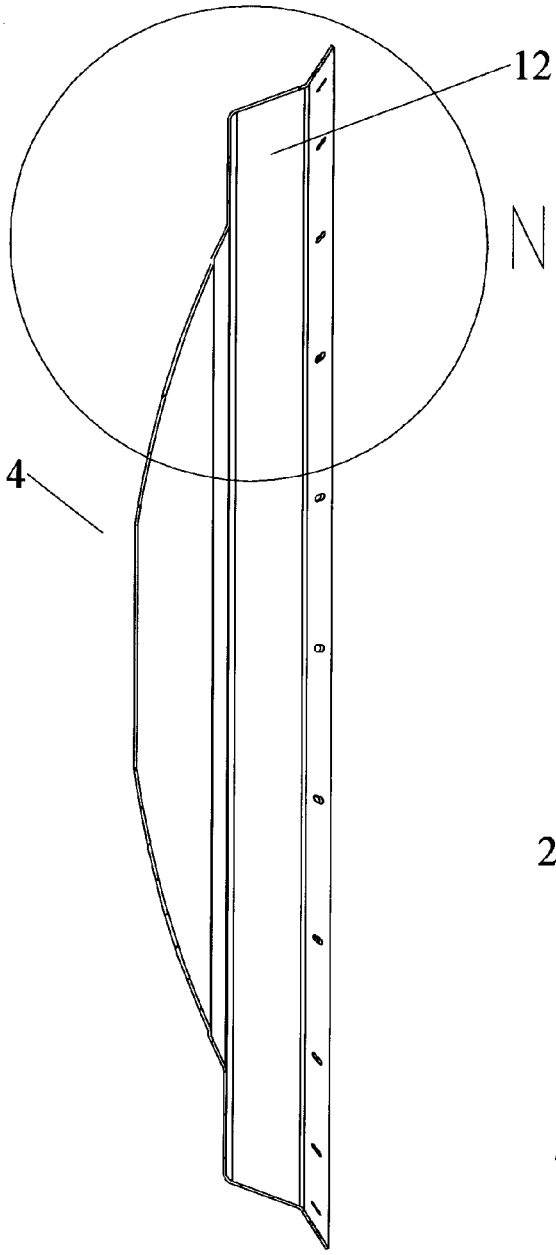
FIG. 6 is a schematic cut-away side view of the central segment of FIG. 1.
Figure 7:
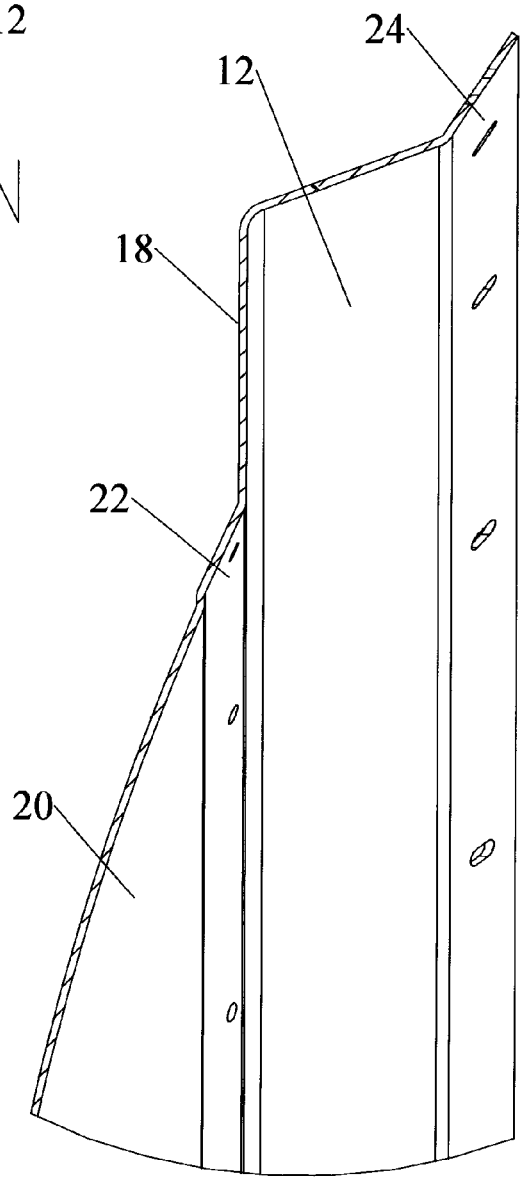
FIG. 7 is a close-up view of area N of FIG. 6.
Figure 8:
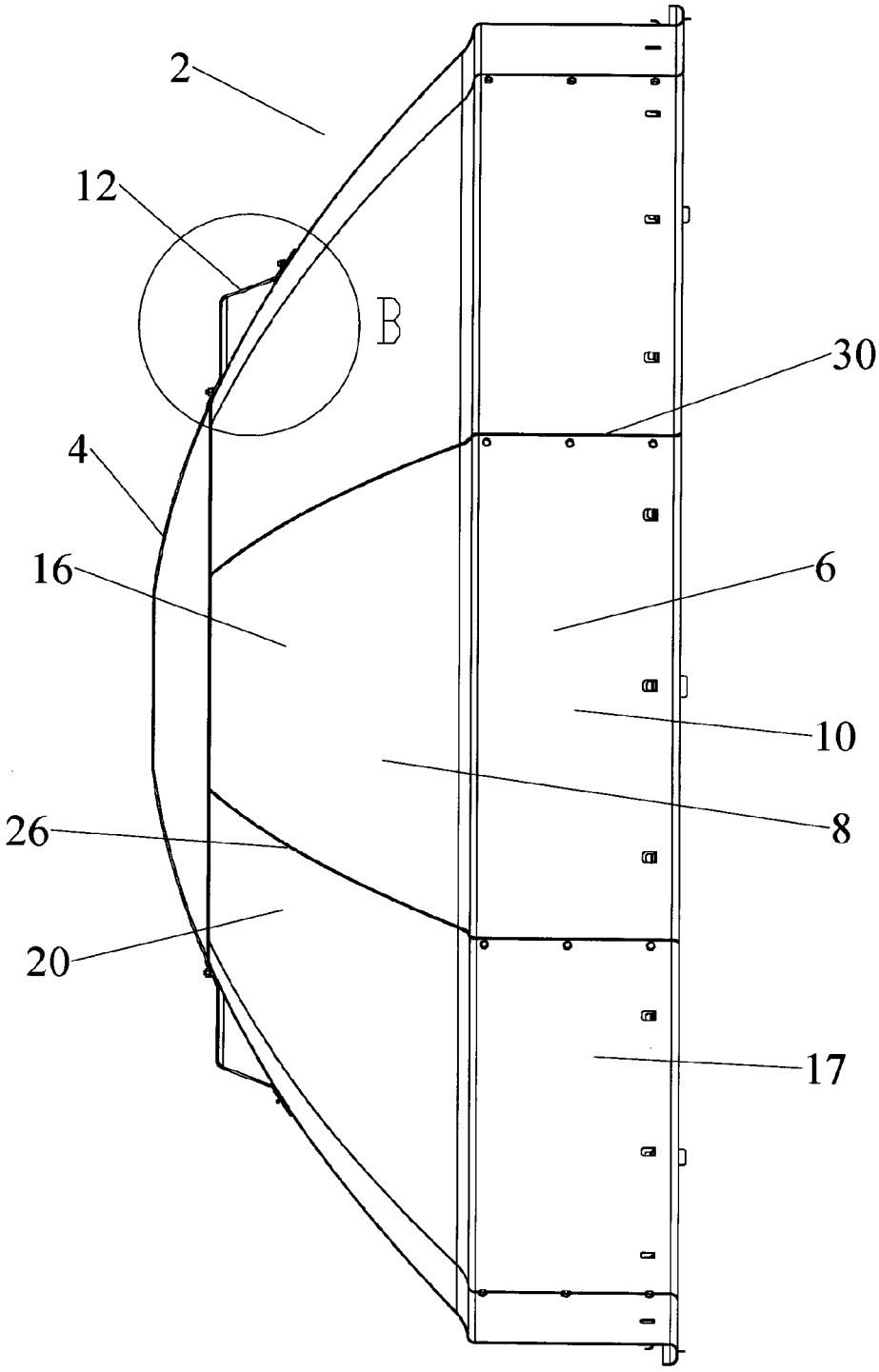
FIG. 8 is a schematic cut-away side view of the antenna reflector of FIG. 1.
Figure 9:
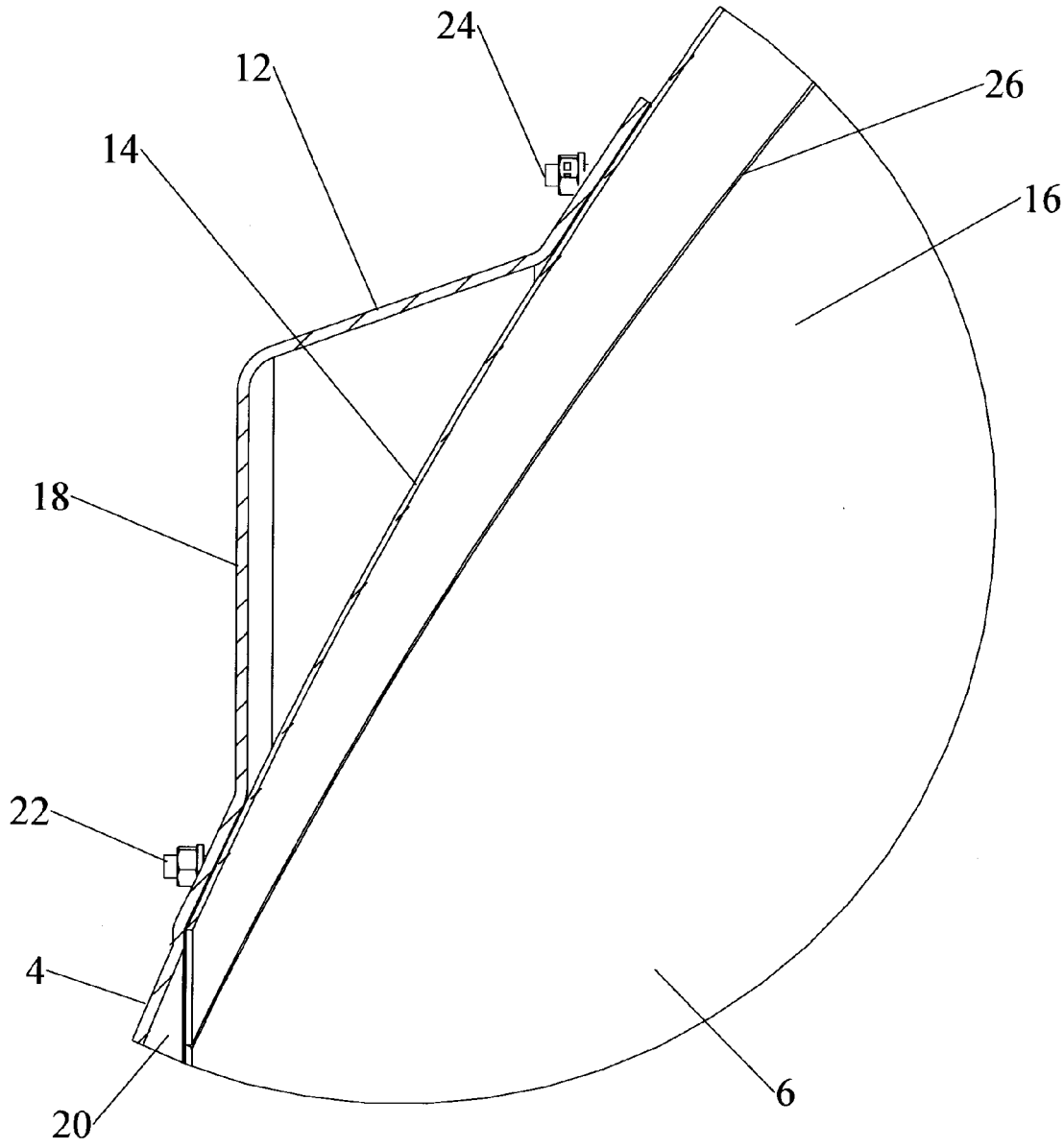
FIG. 9 is a close-up view of area B of FIG. 8.

The central segment 4, as best shown in FIGS. 5-7, provides reinforcing support for the attached peripheral segment (s) 6 via the peripheral coupling portion 12. The peripheral coupling portion 12 (FIG. 7) is provided with a reinforcing portion 18 spaced away from a reflective surface 20 of the reflector dish 16. As best shown in FIGS. 8 and 9, the spaced away reinforcing portion 18, for example forming a generally triangular cross section with respect to the antenna reflector, may also be utilized as a mounting surface for equipment and/or mounting interconnections of the reflector antenna assembly, whereby fasteners applied to this surface do not require piercing or other interruption of the reflective surface 20 of the reflector dish 16.

The proximal portion 14 of each peripheral segment 6 preferably couples to the peripheral coupling portion 12 on both a proximal side 20 and a distal side 22 of the reinforcing portion 18, significantly improving a rigidity characteristic of the assembled antenna reflector 2. The coupling may be via, for example, fasteners such as screws, bolts or the like, applied in two rings generally concentric with the periphery of the reflector dish 16 along each side of the reinforcing portion 18.

The weight to strength ratio and further structural characteristics of the antenna reflector 2 may be further optimized by providing a central segment 4 sized such that the central segment 4, measured with respect to the diameter of the reflective surface 20, is between 30 and 60 percent of a peripheral diameter of the reflector dish. Further, the central segment 4 may be formed with a material thickness that is greater than a material thickness of the peripheral segment(s) 6.

Figure 10:
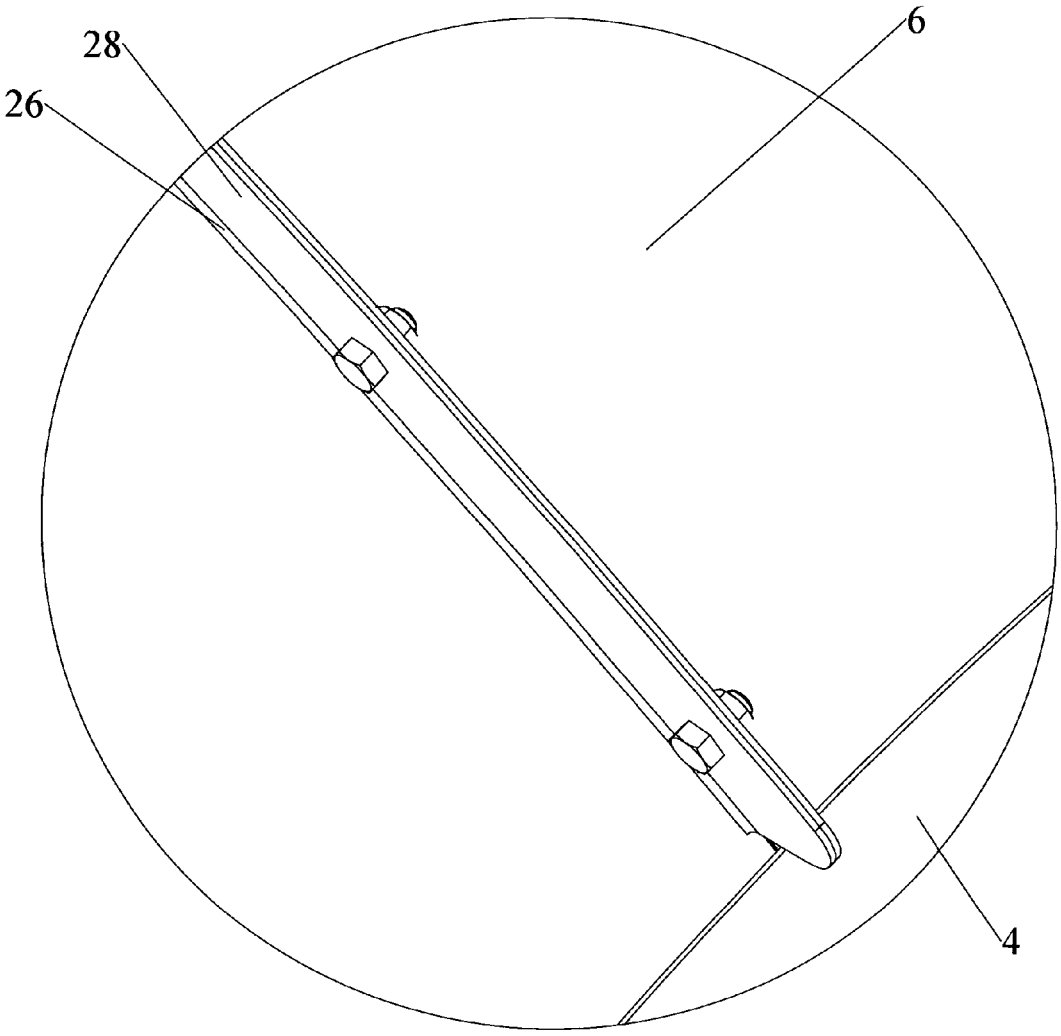
FIG. 10 is a close-up view of area D of FIG. 2.

The peripheral segment(s) 6 may also be strengthened by utilizing coupling between adjacent peripheral segment(s) 6 along a reflector portion edge 26 via fasteners applied through adjacent reflector flange(s) 28, the reflector flange(s) 28 extending generally perpendicular to the reflective surface 20 of the reflector dish 16, as best shown in FIG. 10.

One skilled in the art will appreciate that a segmented antenna reflector 2 as claimed may provide significant cost efficiencies, for example, with respect to manufacture, inventory, transportation and/or installation.

The central segment 4 and peripheral segment(s) 6 may be manufactured with a high level of precision via metal stamping, with material cost and overall weight savings by the application of a thicker gauge of material to the central segment 4, than the peripheral segment(s) 6, as the central segment significantly reinforces the peripheral segment(s) 6 and also bears the stress of supporting additional equipment and/or mounting hardware of the antenna assembly. Further, the peripheral segment 6 incorporating both reflector portion 8 and shield portion 10 provides an additional circumferential band integral with but at an angle to the reflector dish 16, which may improve the strength characteristics of the assembled antenna reflector 2.

Figure 11:
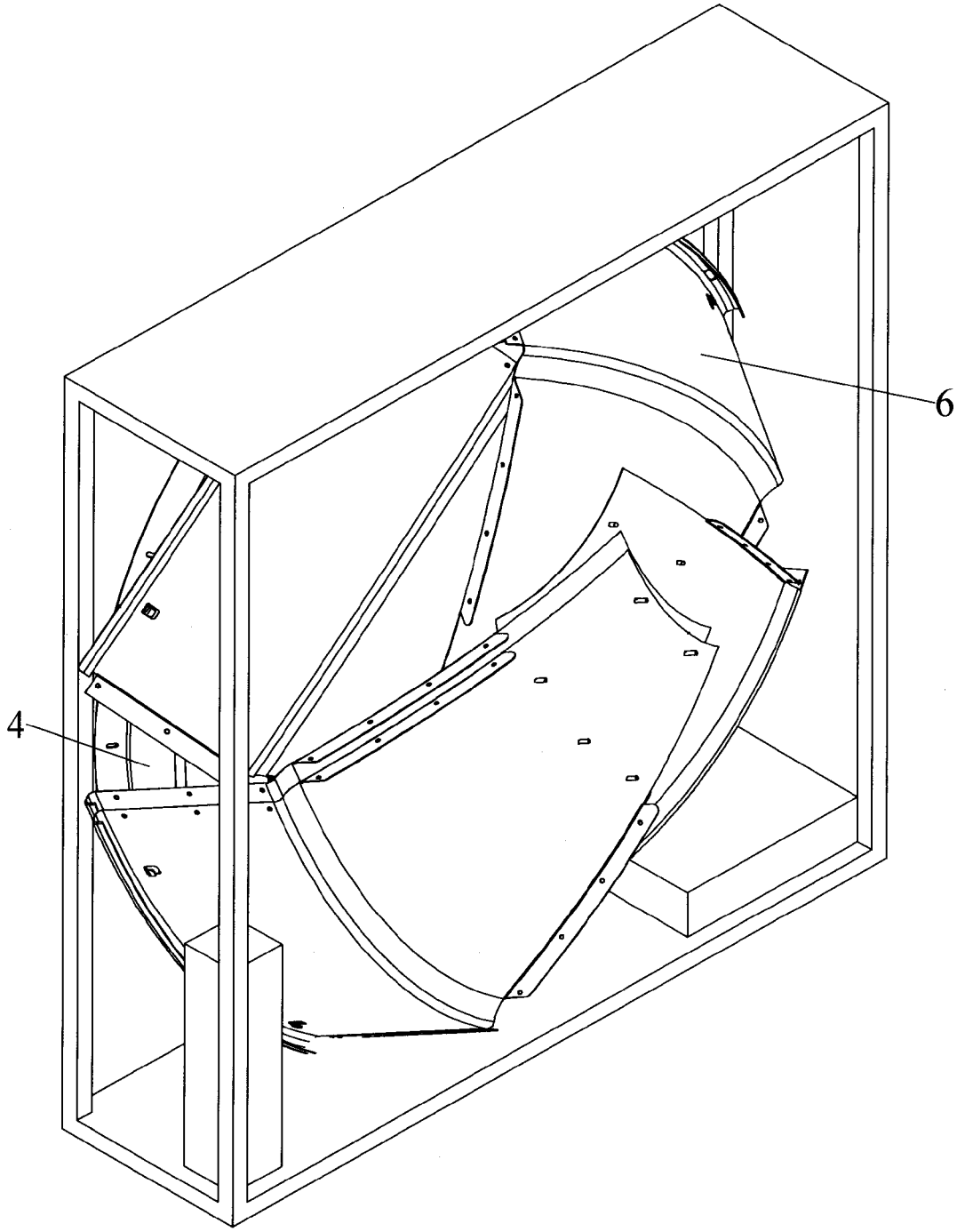
FIG. 11 is a schematic isometric view of an exemplary packaging arrangement of the antenna reflector of FIG. 1.
Figure 12:
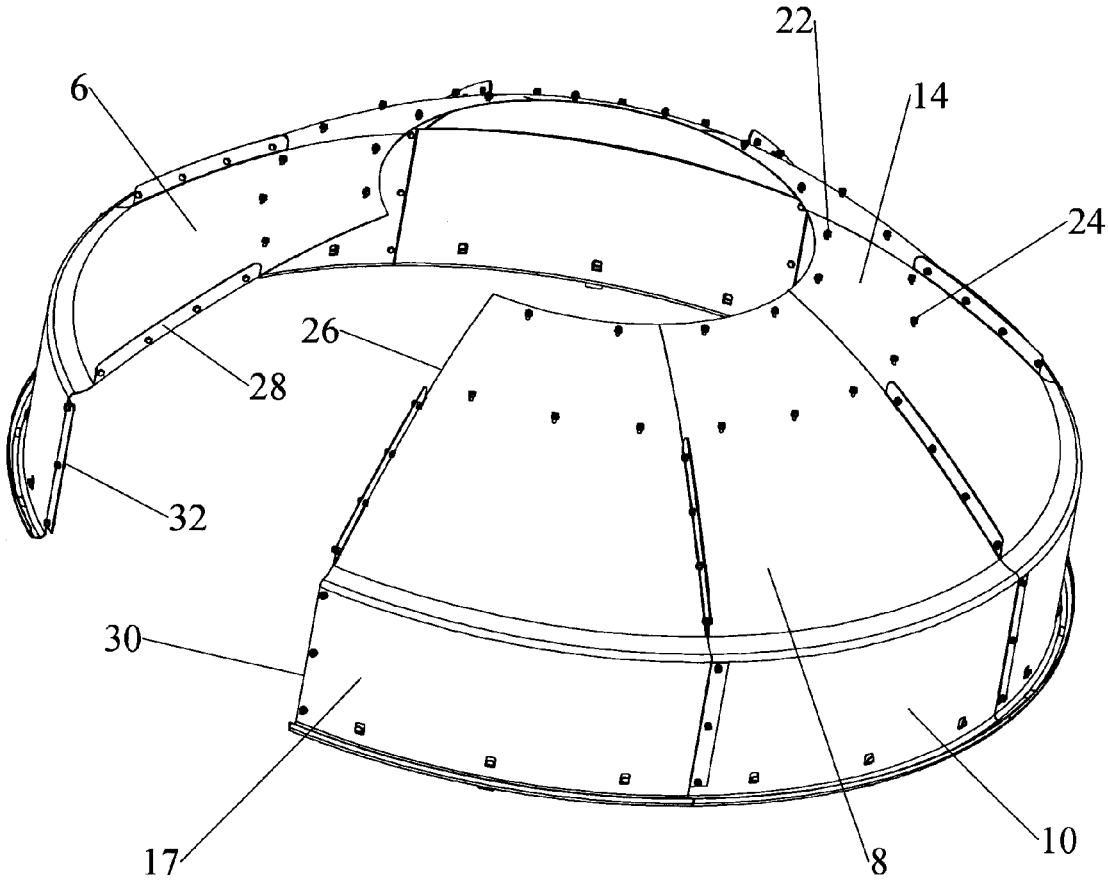
FIG. 12 is a schematic isometric view of the antenna reflector of FIG. 1, partially assembled, with one peripheral segment removed.
Figure 13:
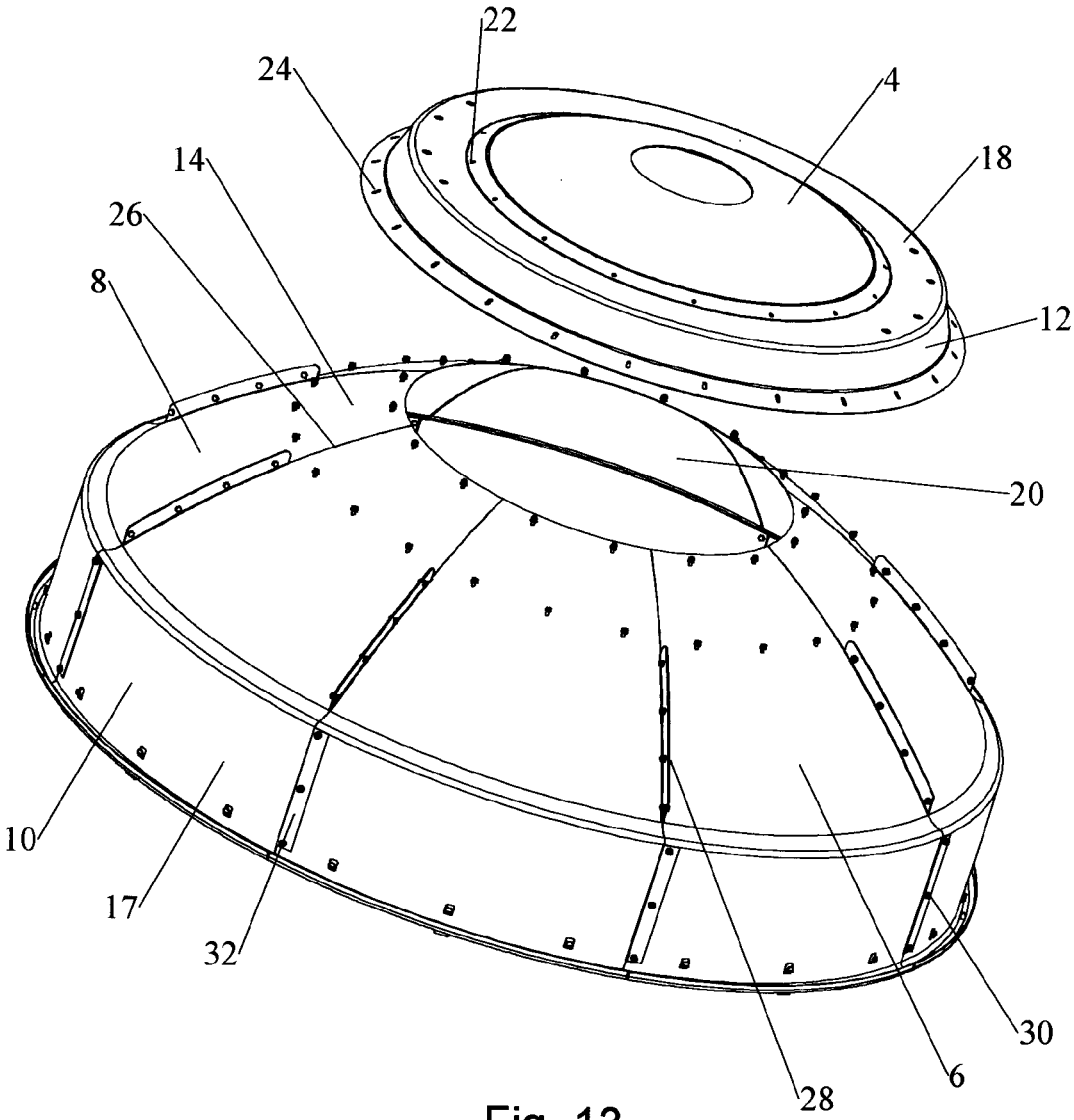
FIG. 13 is a schematic isometric view of the antenna reflector of FIG. 1, partially assembled and ready for central segment attachment.

During inventory and/or transportation, the antenna reflector 2 may be tightly packed, for example as shown in FIG. 11, into a package primarily constrained by the diameter of the central segment 4, which results in a package dimension much less than a traditional unitary body reflector dish reflector antenna configuration. During installation, especially in remote areas, the small package enables ease of transport and site delivery where traditional motor transport may not be available. Also, field assembly of the antenna reflector 2 is greatly simplified, for example as shown in FIGS. 12 and 13, because the various flanges and tabs may be applied in self aligning fashion and a significant amount of hardware for the prior separate attachment of a shield assembly to the reflector dish periphery may be eliminated.

Table of Parts

| | |
|---|---|
| 2 | antenna reflector |
| 4 | central segment |
| 6 | peripheral segment |
| 8 | reflector portion |
| 10 | shield portion |
| 12 | peripheral coupling portion |
| 14 | proximal portion |
| 16 | reflector dish |
| 17 | circumferential shield |
| 18 | reinforcing portion |
| 20 | reflective surface |
| 22 | proximal side |
| 24 | distal side |
| 26 | reflector portion edge |
| 28 | reflector flange |
| 30 | shield portion edge |
| 32 | shield tab |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An antenna reflector, comprising:

a central segment with a peripheral coupling portion;

a plurality of peripheral segments;

each of the peripheral segments provided with a reflector portion and a shield portion;

a proximal portion of each shield portion dimensioned to couple with the peripheral coupling portion;

a reflector portion edge of each peripheral segment dimensioned to couple with adjacent reflector portion edges and a shield portion edge of each peripheral segment dimensioned to couple with adjacent shield portion edges;

the central segment and the reflector portion of the peripheral segments together providing a reflector dish;

the shield portion angled with respect to the reflector portion, adjacent shield portions together providing a circumferential shield extending from a periphery of the reflector dish along an antenna boresight of the reflector dish.

2. The reflector of claim 1, wherein the circumferential shield projects generally perpendicular to a plane of the reflector dish periphery.

3. The reflector of claim 1, wherein the peripheral coupling portion is provided with a reinforcing portion spaced away from a surface of the reflector dish, the proximal portion of each peripheral segment coupled to the peripheral coupling portion on both a proximal side and a distal side of the reinforcing portion.

4. The reflector of claim 1, wherein the peripheral coupling portion is provided with a reinforcing portion spaced away from a surface of the reflector dish, the reinforcing portion and the proximal portion of each peripheral segment forming a generally triangular cross section.

5. The reflector of claim 1, wherein the proximal portion of the peripheral segments are coupled to the peripheral coupling portion via two rings of fasteners generally concentric with the periphery of the reflector dish.

6. The reflector of claim 1, wherein the proximal portion of the peripheral segments are coupled to the peripheral coupling portion via fasteners projecting from the proximal portion of the peripheral segments.

7. The reflector of claim 1, wherein a ratio of a diameter of the reflector dish provided by the central segment is between 30 and 60 percent of a peripheral diameter of the reflector dish.

8. The reflector of claim 1, wherein the circumferential shield extends from the periphery of the reflector dish by at least 10 percent of a peripheral diameter of the reflector dish.

9. The reflector of claim 1, wherein the central portion has a material thickness that is greater than a material thickness of the peripheral segments.

10. The reflector of claim 1, wherein a ratio of a diameter of the reflector dish provided by the central segment is between 30 and 60 percent of a peripheral diameter of the reflector dish;

the circumferential shield extends from the periphery of the reflector dish by at least 10 percent of a peripheral diameter of the reflector dish; and the central portion has a material thickness that is greater than a material thickness of the peripheral segments.

11. The reflector of claim 1, wherein the coupling between the reflector portion edge of each peripheral segment is via a reflector flange extending generally perpendicular to the reflector dish.

12. The reflector of claim 1, wherein the coupling between the shield portion edges is via an overlapping shield tab.

13. A method of manufacture for an antenna reflector, comprising the steps of:

providing a central segment with a peripheral coupling portion;

providing a plurality of peripheral segments;

each of the peripheral segments provided with a reflector portion and a shield portion;

coupling a proximal portion of each shield portion with the peripheral coupling portion;

coupling a reflector portion edge of each peripheral segment with adjacent reflector portion edges and a shield portion edge of each peripheral segment dimensioned to couple with adjacent shield portion edges;

the central segment and the reflector portion of the peripheral segments together providing a reflector dish;

the shield portion angled with respect to the reflector portion, adjacent shield portions together providing a circumferential shield extending from a periphery of the reflector dish along an antenna boresight of the reflector dish.

14. The method of claim 13, wherein the central segment is provided in a first material that is thicker than a second material of the peripheral segments.

15. The method of claim 13, wherein a ratio of a diameter of the reflector dish provided by the central segment is between 30 and 60 percent of a peripheral diameter of the reflector dish.

16. The method of claim 13, wherein the circumferential shield extends from the periphery of the reflector dish by at least 10 percent of a peripheral diameter of the reflector dish.

17. The method of claim 13, wherein the central segment is provided in a first material that is thicker than a second material of the peripheral segments; a ratio of a diameter of the reflector dish provided by the central segment is between 30 and 60 percent of a peripheral diameter of the reflector dish; and the circumferential shield extends from the periphery of the reflector dish by at least 10 percent of a peripheral diameter of the reflector dish.

18. An antenna reflector, comprising:

a central segment with a peripheral coupling portion;

a plurality of peripheral segments;

each of the peripheral segments provided with a reflector portion and a shield portion;

a proximal portion of each shield portion dimensioned to couple with the peripheral coupling portion;

the central segment and the reflector portion of the peripheral segments together providing a reflector dish;

the shield portion angled with respect to the reflector portion, adjacent shield portions together providing a circumferential shield extending from a periphery of the reflector dish along an antenna boresight of the reflector dish.

19. The reflector of claim 18, wherein the peripheral coupling portion is provided with a reinforcing portion spaced away from a surface of the reflector dish, the proximal portion of each peripheral segment coupled to the peripheral coupling portion on both a proximal side and a distal side of the reinforcing portion.

20. The reflector of claim 18, wherein the peripheral coupling portion is provided with a reinforcing portion spaced away from a surface of the reflector dish, the reinforcing portion and the proximal portion of each peripheral segment forming a generally triangular cross section.

* * * * *